US006710550B2

(12) United States Patent
Bang

(10) Patent No.: US 6,710,550 B2
(45) Date of Patent: Mar. 23, 2004

(54) PLASMA DISPLAY PANEL APPARATUS AND METHOD OF PROTECTING AN OVER CURRENT THEREOF

(75) Inventor: Jeong-ho Bang, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 0 days.

(21) Appl. No.: 10/183,526

(22) Filed: Jun. 28, 2002

(65) Prior Publication Data

US 2003/0137254 A1 Jul. 24, 2003

(30) Foreign Application Priority Data

Jan. 21, 2002 (KR) ..... 2002-3386

(51) Int. Cl.[7] ..... G09G 3/10; G09G 3/28
(52) U.S. Cl. ..... 315/169.4; 345/60
(58) Field of Search ..... 315/169.1, 169.3, 315/169.4; 345/60, 55, 58

(56) References Cited

U.S. PATENT DOCUMENTS

| | | | | |
|---|---|---|---|---|
| 5,642,018 A | * | 6/1997 | Marcotte | 315/169.4 |
| 5,717,437 A | * | 2/1998 | Sano et al. | 345/211 |
| 6,483,250 B1 | * | 11/2002 | Hashimoto et al. | 315/169.4 |
| 6,538,627 B1 | * | 3/2003 | Whang et al. | 345/60 |

FOREIGN PATENT DOCUMENTS

| | | |
|---|---|---|
| EP | 0895217 | 2/1999 |
| JP | 8-160901 | 6/1996 |
| JP | 11-52910 | 2/1999 |
| JP | 2000-206919 | 7/2000 |
| JP | 2000-242225 | 9/2000 |
| JP | 2000-293131 | 10/2000 |
| KR | 1999-75293 | 10/1999 |
| KR | 2000-9131 | 2/2000 |
| KR | 2001-2189 | 1/2001 |
| KR | 2001-28539 | 4/2001 |

* cited by examiner

*Primary Examiner*—Don Wong
*Assistant Examiner*—Minh D A
(74) *Attorney, Agent, or Firm*—Sughrue Mion, PLLC

(57) ABSTRACT

A plasma display panel apparatus includes a pair of discharge sustaining electrodes, a panel capacitor to supply charged voltage alternately to each electrode of the pair of discharge sustaining electrodes, a switching device for discharge that is turned on when the panel capacitor is discharged, to thereby pass through discharged current of the panel capacitor, a current sensing part to sense the current passed through by the switching device for discharge, and an over-current controlling part that turns off the switching device for discharge when the current sensed in the current sensing part is at or above a predetermined reference value. With this configuration, the plasma display panel apparatus protects the switching device from over-current generated during an abnormal driving of the discharge sustaining electrode driving circuit.

20 Claims, 4 Drawing Sheets

PLASMA DISPLAY PANEL APPARATUS AND METHOD OF PROTECTING AN OVER CURRENT THEREOF

CROSS-REFERENCE TO RELATED APPLICATION

This application claims the benefit of Korean Application No. 2002-3386, filed Jan. 21, 2002, in the Korean Intellectual Property Office, the disclosure of which is incorporated herein by reference.

BACKGROUND OF THE INVENTION

1. Field of the Invention

The present invention relates in general to plasma display apparatuses, and more particularly, to a plasma display apparatus having an over-current protection circuit that protects a switching device from an over-current generated during an abnormal driving of a driving circuit of a discharge sustaining electrode and a method of protecting over-current thereof.

2. Description of the Related Art

A plasma display panel (PDP) is a display apparatus using a discharge of gas. The PDP is generally classified into a direct current (DC) type that applies a facing discharge, and an alternating current (AC) type that applies a surface discharge, depending upon its driving type. The AC type PDP has attracted more attention because it has a lower power consumption and a longer lifetime in comparison with the DC type.

The PDP using the AC driving type applies an alternating current (AC) voltage between electrodes insulated with a dielectric layer, and performs a discharge every half-cycle of the AC voltage, which is used to display a picture mainly in a sub-field method. In the sub-field method, since the power consumption used for a charge and the discharge of the PDP panel during the sustain of the discharge is very large, a circuit is used to collect reactive power in a driving device of the PDP.

As illustrated in FIG. 2, a circuit to drive the discharge sustaining electrode generally includes a unit driving cell of a discharge sustaining electrode connected to a Y-electrode (hereinafter referred to as 'Y-electrode unit driving cell') and a unit driving cell of a common electrode connected in common to a plurality of X-electrodes (hereinafter referred to as 'X-electrode unit driving cell'). The Y-electrode and the X-electrode perform a surface discharge with supplied sustain pulses generated in the X-electrode unit driving cell and the Y-electrode unit driving cell as sustaining electrode pairs. By this, brightness of the picture displayed on a screen is sustained. Here, a panel capacitor 41 indicates equivalently electrostatic capacity formed between the Y-electrode and the X-electrode in the panel.

Referring to FIG. 2, the Y-electrode unit driving cell includes a capacitor 43*a* to collect energy, first and third switches 35*a*, 37*a* connected in parallel with the energy collecting capacitor 43*a*, second and fourth switches 31*a*, 33*a* connected in series between a voltage supply source Vcc1 and a ground, and a coil 39*a* connected between a first node n1 and a second node n2. The X-electrode unit driving cell is positioned symmetrically relative to the Y-electrode unit driving cell through the panel capacitor 41.

To the branch point of the first node n1 and the second switch 31*a* are connected a reset resistance 45, a reset capacitor 47 and a reset switch 48 to reset a voltage of the panel capacitor 41. If the reset switch 48 is turned on, the voltages charged in the panel capacitor 41, the X-electrode unit driving cell, and the Y-electrode unit driving cell become uniform.

An operation of the discharge sustaining electrode driving circuit will be described below with reference to FIGS. 3A to 3E. The second switch 31*a* and a switch 49 to connect to the panel capacitor 41 (hereinafter, "panel capacitor connecting switch") are turned on during the reset, and the electric current then flows. If the panel capacitor connecting switch 49 is turned off during the flow of the electric current, the reset switch 48 is turned on. Thus, a bypass current is formed by the reset capacitor 47 and the reset switch 48. At this time, the electric current flowing in the panel capacitor 41 constitutes a reset pulse.

If the panel capacitor connecting switch 49 and the third switch 37*a* are turned on after the circuit is in the reset state and the current charged in the panel capacitor 41 is discharged, electric charge is transmitted to the energy collecting capacitor 43*a* and charging is performed. The first switch 35*a* and the panel capacitor connecting switch 49 are turned on during a voltage rising time t0 of the discharge sustaining pulse. An electric current due to the energy charged in the energy collecting capacitor 43*a* is transmitted to the panel capacitor 41, through the first switch 35*a*, the coil 39*a* and the panel capacitor connecting switch 49. On an end of the voltage rising time t0 of the discharge sustaining pulse, the second switch 31*a* and the panel capacitor connecting switch 49 are turned on, thereby allowing the discharge sustaining pulse to remain in a "high" state t1. On an end terminal point of the discharge sustaining pulse in the t1, the third switch 37*a* and the panel capacitor connecting switch 49 are turned on, the voltage of the discharge sustaining pulse reduces to a "low" state. The electric current due to the energy charged in the panel capacitor 41 is stored in the energy collecting capacitor 43*a* through the panel capacitor connecting switch 49 and the third switch 37*a*, and the discharge sustaining pulse is in the "suspension" state. On an end point of a falling time t2 of the discharge sustaining pulse, the fourth switch 33*a* and the panel capacitor connecting switch 49 are turned on and the panel capacitor 41 is completely discharged, so the discharge sustaining pulse remains in the "low" state t3. The discharge is sustained through a repetition of the above-described processes.

If a sub-field ends, each switch 31*a*, 33*a*, 35*a*, 37*a*, 48, 49 is turned on or off so as to return back to the "reset" state to maintain the discharge sustaining pulse, and the discharge process is progressed, thereby allowing a plasma display panel to emit light. Also, like the Y-electrode unit driving cell, the X-electrode unit driving cell operates alternately with the Y-electrode unit driving cell through the above-described processes.

However, if any of the switches 31*a*, 33*a*, 35*a*, 37*a*, 48, 49 are abnormally turned on at the same time during the process of applying an on/off control signal to each of the switches 31*a*, 33*a*, 35*a*, 37*a*, 48, 49 while a conventional discharge sustaining electrode driving circuit has been driven, over-current flows into the switches 31*a*, 33*a*, 35*a*, 37*a*, 48, 49 by which they may be damaged.

SUMMARY OF THE INVENTION

The present invention has been made keeping in mind the above-described and other shortcomings, and an object of the present invention is to provide a plasma display apparatus having an over-current protection circuit that protects a switching device from the over-current generated during an abnormal driving of the driving circuit of discharge sustaining electrode.

Additional objects and advantages of the invention will be set forth in part in the description which follows and, in part, will be obvious from the description, or may be learned by practice of the invention.

This and other objects of the present invention may be achieved by providing a plasma display panel apparatus according to an embodiment of the invention that includes a pair of discharge sustaining electrodes, a panel capacitor to supply charged voltage alternately to each electrode of the pair of discharge sustaining electrodes, at least one discharge switching device to perform a discharge, the switching device being turned on when the panel capacitor is discharged to thereby pass through discharged current of the panel capacitor, a current sensing part to sense the current passing through the discharge switching device, and an over-current controlling part to turn off the discharge switching device when the current sensed in the current sensing part is at or higher than a predetermined reference value.

According to an aspect of the invention, the current sensing part comprises a current sensing resistance connected in series to the discharge switching device, and the over-current controlling part comprises a comparator to compare the sensed voltage detected in the current sensing resistance with a predetermined internal reference value and to output a break signal, and switching device to break the current to control the discharge switching device to be turned on or off according to a "high" or "low" signal of the break signal.

According to another aspect of the invention, the over-current controlling part further includes a direct current (DC) converting part positioned between the current sensing resistance and the comparator.

According to a further aspect of the invention, the over-current controlling part further includes an OR gate disposed between the comparator and the break switching device.

According to yet another aspect of the invention, the discharge switching device comprises a field effect transistor.

According to a still further aspect of the invention, the over-current controlling part further includes a microcomputer to turn off the discharge switching device when the sensed current of the current sensing part is at or higher than the predetermined value.

According to another embodiment of the invention, a method of protecting over-current of a plasma display panel apparatus that includes a pair of discharge sustaining electrodes, a panel capacitor to alternately supply a charged voltage to each electrode of the pair of the discharge sustaining electrodes, and a plurality of switching devices to control the charged voltage to be alternately supplied from the panel capacitor to each electrode of the pair of discharge sustaining electrodes, the method comprising sensing current passing through the discharge switching device, and turning off the discharge switching device when the sensed current is at or higher than a predetermined reference value.

According to an additional aspect of the invention, the turning off the discharge switching device comprises converting the voltage according to the sensed current into direct current voltage, and turning off the discharge switching device where the converted direct current voltage is at or higher than a predetermined reference value.

BRIEF DESCRIPTION OF THE DRAWINGS

The present invention will be better understood and its various objects and advantages will be more fully appreciated from the following description of the embodiments taken in conjunction with the accompanying drawings, in which.

DETAILED DESCRIPTION OF THE EMBODIMENTS

Figure 1:
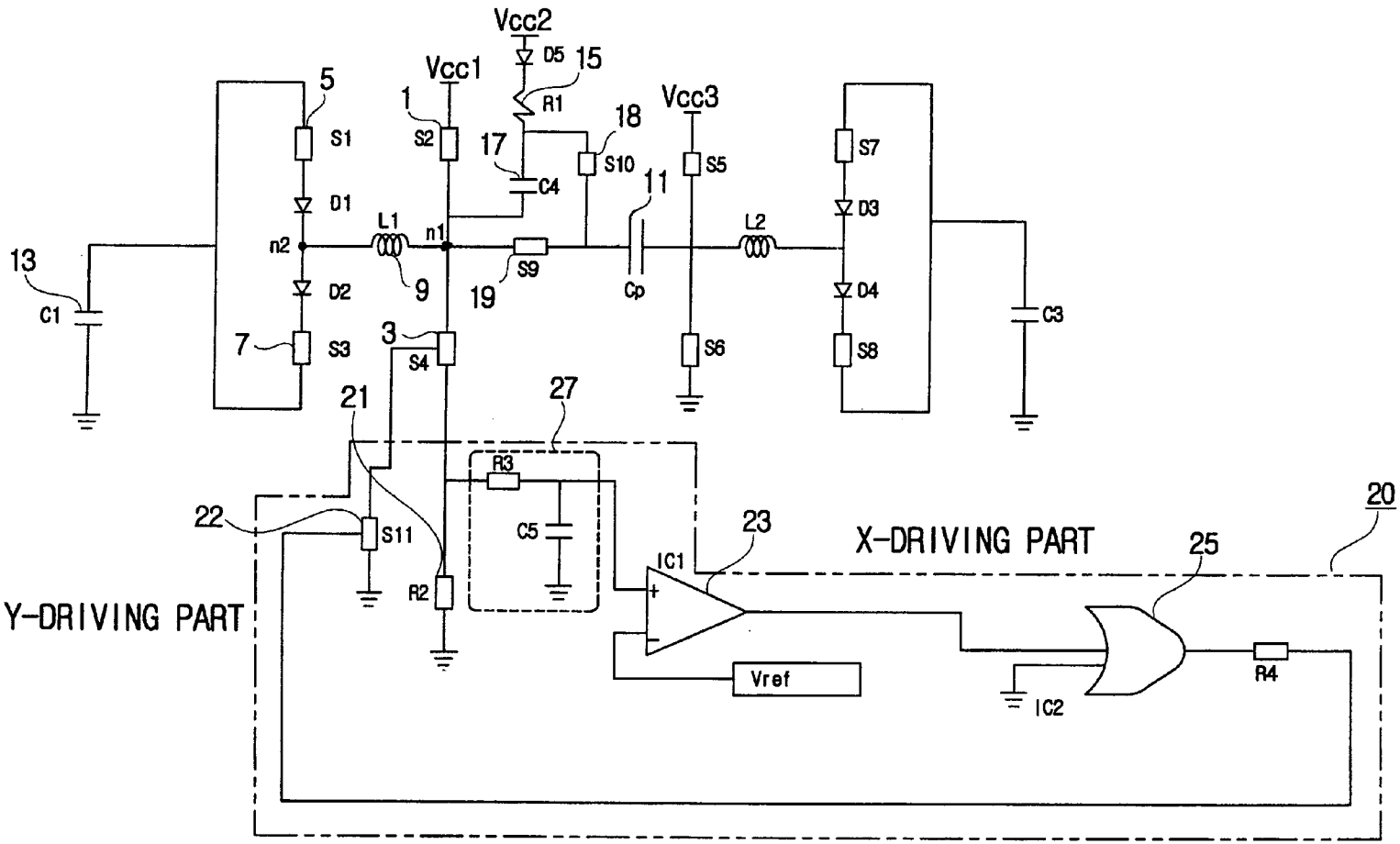
FIG. 1 is a schematic showing an over-current protected circuit of a discharge sustaining electrode driving circuit of a plasma display panel apparatus according to an embodiment of the present invention.
Figure 2:
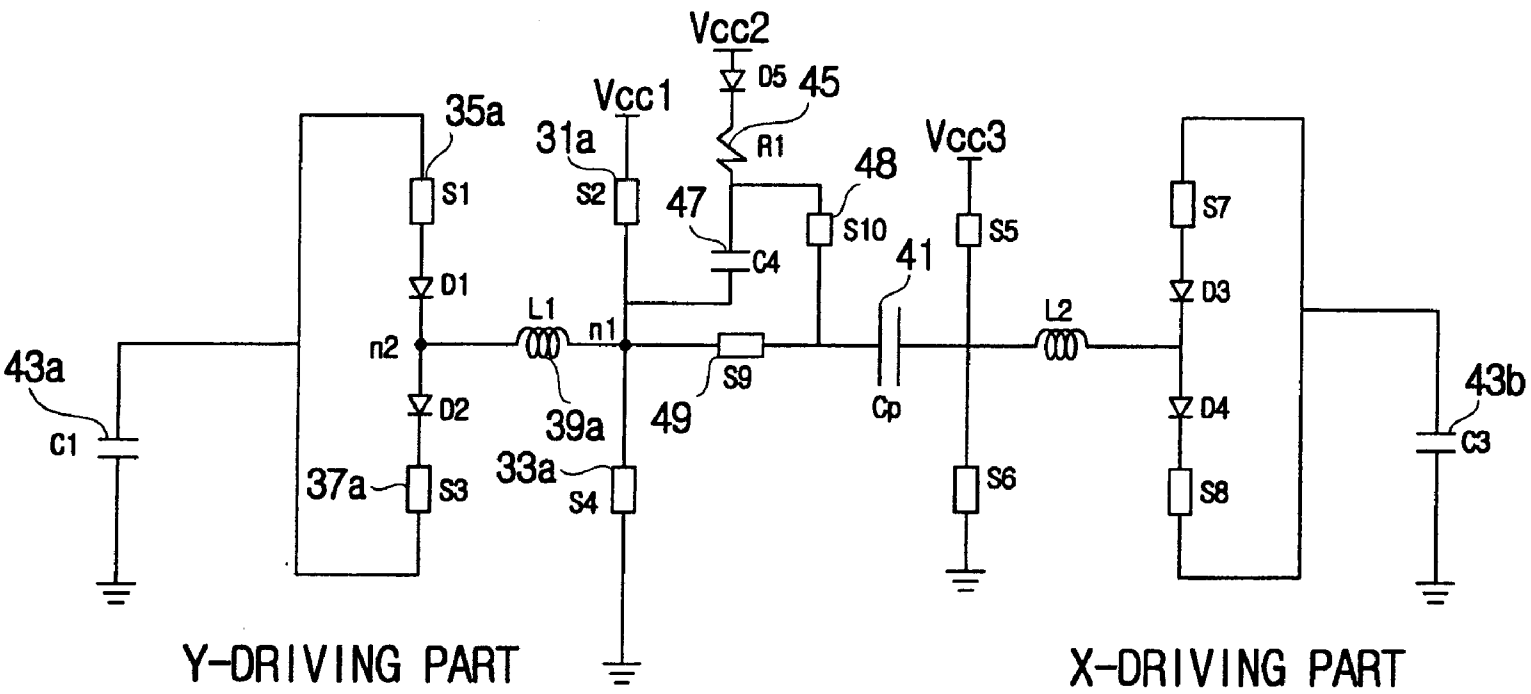
FIG. 2 (PRIOR ART)
FIG. 2 is a schematic view showing a discharge sustaining electrode driving circuit of a conventional plasma display panel apparatus.
Figures 3A, 3B, 3C, 3D, 3E:
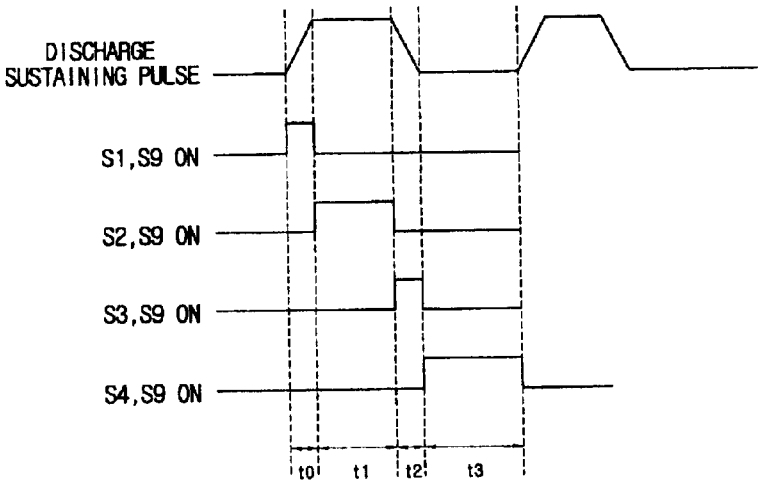
FIG. 3A (PRIOR ART)
FIG. 3B (PRIOR ART)
FIG. 3C (PRIOR ART)
FIG. 3D (PRIOR ART)
FIG. 3E (PRIOR ART)
FIGS. 3A to 3E show a relation between switching states and a discharge sustaining pulse of the discharge sustaining electrode driving circuit of FIG. 2.

Hereinbelow, the present invention will be described in more detail, examples of which are illustrated in the accompanying drawings wherein like reference numerals refer to the like elements throughout. The embodiments are described below in order to explain the present invention by referring to the figures.

Figure 4:
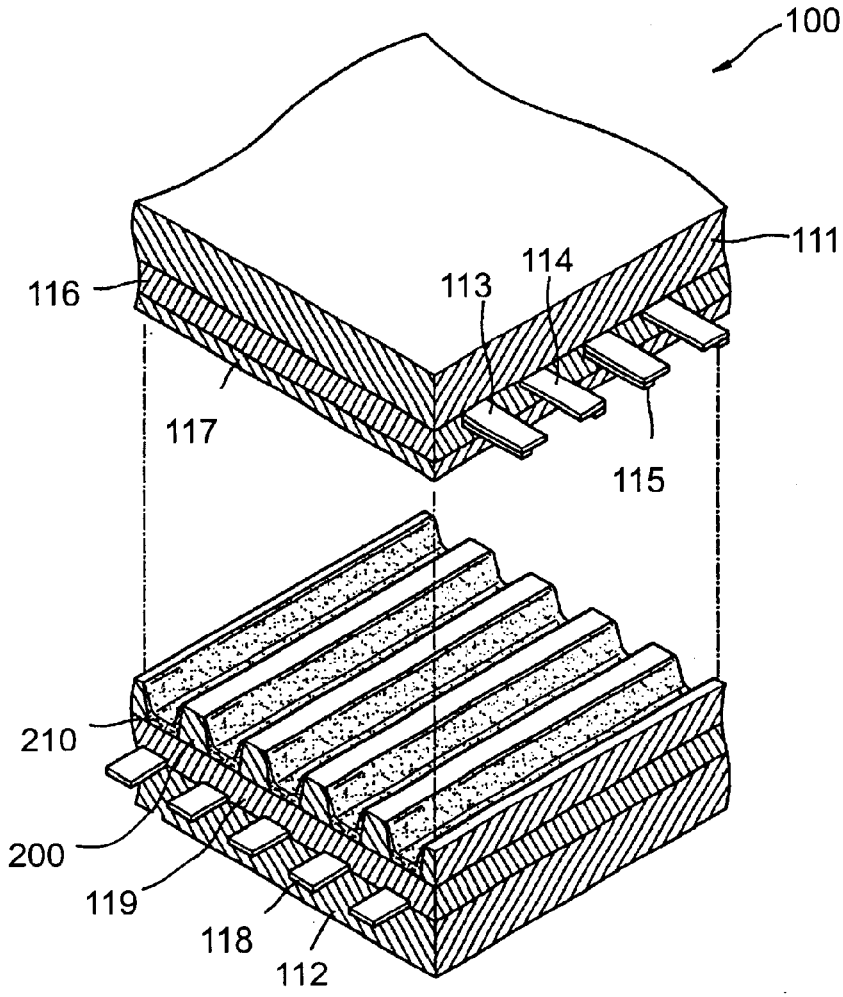
FIG. 4 is a perspective view of a plasma display panel according to an embodiment of the invention.

FIG. 1 is a schematic view showing a discharge sustaining electrode driving circuit of a PDP shown in FIG. 4 according to an embodiment of the present invention. A circuit to drive a discharge sustaining electrode includes a unit driving cell of the discharge sustaining electrode connected to Y-electrode 114 (hereinafter referred to as "Y-electrode unit driving cell"), a unit driving cell of common electrodes connected commonly to a plurality of X-electrodes 113 (hereinafter referred to as "X-electrode unit driving cell"), and a panel capacitor 11 to supply voltages to the X-electrodes 113 and the Y-electrodes 114. Here, the panel capacitor 11 indicates an equivalent capacitance formed between the Y-electrodes 114 and the X-electrodes 113. The Y-electrodes 114 and the X-electrode 113 perform a surface discharge by sustain pulses generated in the Y-electrode unit driving cell and the X-electrode unit driving cell, thereby sustaining brightness of a picture displayed.

The Y-electrode driving cell comprises an energy collecting capacitor 13, first and third switches 5, 7 connected in parallel to the energy collecting capacitor 13, second and fourth switches 1, 3 connected in series between a discharge sustaining voltage supply source Vcc1 and a ground, and a coil 9 connected between a first node n1 and a second node n2. Here, the first through fourth switches 1, 3, 5, 7 are field effect transistors (FETs).

To the branch point of the first node n1 and the second switch 1 are connected a reset resistance 15 and a reset capacitor 17 to reset a voltage of the panel capacitor 11. To the branch point of the reset resistance 15 and the reset capacitor 17 is connected a reset switch 18. When the reset switch 18 is turned on, the voltages charged in the panel capacitor 11, the X-electrode 113 and the Y-electrode 114 are reset to be uniform. The structure of the X-electrode unit driving cell is symmetrical relative to the Y-electrode unit driving cell, in the center of which the panel capacitor 11 is placed. Herein, description of an operation of driving the discharge sustaining electrode driving circuit will be omitted because it is otherwise generally the same as that of a conventional discharge sustaining electrode driving circuit.

According to the present invention, the Y-electrode unit driving cell includes an over-current protection circuit 20 to protect the driving cell from the over-current. The over-current protected circuit 20 comprises an over-current sensing resistance 21 connected in series to a source terminal of the fourth switch 3, which is an FET according to an embodiment of the invention. A direct current (DC) converting circuit 27 converts the voltage sensed in the over-current sensing resistance 21 into a direct current. A comparator 23 compares the sensed voltage converted into the direct current in the DC converting circuit 27 with a predetermined reference value and to output a "high" signal when the sensed voltage is at or higher than the predetermined reference value. An OR gate 25 adds the output signal of the comparator 23 and a ground voltage ("low") by an OR operation thereof, and an over-current breaking switch 22 positioned between an output terminal of the OR gate 25 and a gate terminal of the fourth switch 3. The over-current breaking switch 22 is turned on in response to the "high" signal outputted from the OR gate 25 when there is over-current, to thereby turn off the fourth switch 3.

When the discharge sustaining electrode driving circuit is in an abnormal operation, if the over-current is applied to the reset switch 18 and the fourth switch 3, an over-voltage is applied to the over-current sensing resistance 21. The over-voltage sensed by the over-current sensing resistance 21 is converted into a DC voltage through a resistance R3 and a capacitor C5 of the DC converting circuit 27, and then the sensed DC voltage is applied to a non-inverting "+" terminal of the comparator 23. When the sensed DC voltage is higher than a reference voltage (0V) of the comparator 23, the comparator 23 amplifies a difference between the sensed voltage and the reference voltage, and outputs a "high" signal. The "high" signal outputted from the comparator 23 is transmitted to the OR gate 25. The OR gate 25 adds the "high" signal and the ground voltage (a "low" signal) by the OR operation and outputs the "high" signal. The "high" signal outputted from the OR gate 25 is inputted to the gate terminal of the over-current breaking switch 22, which is an FET according to an aspect of the invention. As such, the over-current breaking switch 22 is turned on and the fourth switch 3 the turned off. The fourth switch 3 is turned off by decreasing a gate voltage of the fourth switch 3 connected to a drain terminal of the over-current breaking switch 22. Accordingly, as the fourth switch 3 is turned off, a current loop flowing between the reset switch 18 and the fourth switch 3 is broken off, and thereby, the reset switch 18 and the fourth switch 3 are protected from the over-current.

When the discharge sustaining electrode driving circuit is in a normal operation, a "low" signal is outputted from the comparator 23. According to this state, the "low" signal is also outputted from the OR gate 25 and inputted into the over-current breaking switch 22, thereby allowing an operation of the over-current breaking switch 22 to be maintained in a turned off state.

The over-current protected circuit 20 described above can also be applied to the X-electrode unit driving cell.

In the above-described embodiment, protection of the switching devices of the discharge sustaining electrode is performed by a device that senses the overcurrent. However, the sensed voltage detected by the over-current sensing resistance 21 can be supplied to a microcomputer controlling the on or off state of each switching device S1 through S4 (i.e., switches 5, 1, 7, 3). According to this embodiment, the microcomputer directly turns off the switching devices S1 through S4 (i.e., switches 5, 1, 7, 3) when the over-current is sensed.

According to an aspect of the invention, any or all of the resistances including resistances 15, 21, R3 are resistors. However, it is understood that other devices can be utilized to provide resistance.

FIG. 4 shows an AC type plasma display panel 100 using the over-current protected circuit 20 according to an embodiment of the invention. The plasma display panel 100 has a front substrate 111 and a rear substrate 112 opposed to and facing each other. Strip-shaped common electrodes 113 and strip-shaped scan electrodes 114 (X and Y electrodes 113, 114) are alternately formed on a bottom surface of the front substrate 111. A bus electrode 115, which reduces the line resistance, is formed on a bottom surface of each of the common and scan electrodes 113 and 114. A first dielectric layer 116 is formed on a bottom surface of the front substrate 111 to cover the common electrodes 113, the scan electrodes 114, and the bus electrodes 115. A protective layer 117, such as a magnesium oxide (MgO), is formed on a bottom surface of the first dielectric layer 116.

Strip-shaped address electrodes 118 are formed on a top surface of the rear substrate 112 to be perpendicular with the common and scan electrodes 113 and 114. The address electrodes 118 are covered by a second dielectric layer 119. Strip-shaped partitions 200 are formed on the second dielectric layer 119 parallel with the address electrodes 118. Red (R), green (G) and blue (B) phosphor layers 210 are formed on the inner walls of the partitions 200.

According to the present invention, where a plurality of switching devices provided in the discharge sustaining electrode driving circuit is abnormally turned on and the over-current flows, such over-current can be broken off.

As described above, according to the present invention, there is provided a plasma display panel device having an over-current protected circuit with which switching devices can be protected from over-current generated by an abnormal driving of the discharge sustaining electrode driving circuit.

Although the embodiments of the present invention have been described for illustrative purposes, those skilled in the art will appreciate that various modifications, additions and substitutions are possible, without departing from the scope and spirit of the invention as disclosed in the accompanying claims and equivalents thereof.

What is claimed is:

1. A plasma display panel apparatus comprising:

a front substrate;

a pair of discharge sustaining electrodes disposed along a first direction on a bottom surface of said front substrate;

a first dielectric layer on the bottom surface of said front substrate to cover said discharge sustaining electrodes;

a rear substrate opposite to and facing said front substrate;

address electrodes on a top surface of said rear substrate, said address electrodes being disposed in a second direction perpendicular with the first direction of said discharge sustaining electrodes;

a second dielectric layer on said rear substrate to cover said address electrodes;

partitions to partition a discharge space under said first dielectric layer, said partitions being on said second dielectric layer;

phosphor layers formed on inner walls of said partitions;

a panel capacitor to alternately supply a charged voltage to each of said discharge sustaining electrodes;

a discharge switching device for use in a discharge of one of said discharge sustaining electrodes, said discharge switching device being turned on when said panel capacitor is discharged to thereby pass discharged current of said panel capacitor through said discharge switching device;

a current sensing part that senses the discharged current passing through said discharge switching device; and an over-current controlling part that turns off said discharge switching device when the discharged current sensed in said current sensing part is at or above a predetermined reference value.

2. The plasma display panel apparatus according to claim 1, wherein:

said current sensing part comprises a current sensing resistance connected in series to said discharge switching device, and said over-current controlling part comprises:

a comparator that compares a sensed voltage detected in the current sensing resistance due to the discharged current with a predetermined internal reference value and outputs a break signal, and a current break switching device that breaks the discharge current and turns said discharge switching device on or off according to whether the break signal is one of a "high" signal or a "low" signal.

3. The plasma display panel apparatus according to claims 2, wherein said discharge switching device comprises a field effect transistor.

4. The plasma display panel apparatus according to claim 2, wherein said over-current controlling part further includes a direct current (DC) converting part positioned between the current sensing resistance and the comparator.

5. The plasma display panel apparatus according to claims 4, wherein said discharge switching device comprises a field effect transistor.

6. The plasma display panel apparatus according to claim 2, wherein said over-current controlling part further includes an OR gate disposed between the comparator and the current break switching device.

7. The plasma display panel apparatus according to claims 6, wherein said discharge switching device comprises a field effect transistor.

8. The plasma display panel apparatus according to claim 2, wherein said over-current controlling part further includes a microcomputer that turns off said discharge switching device when the sensed discharge current of said current sensing part is at or above the predetermined internal reference value.

9. The plasma display panel apparatus according to claims 1, wherein said discharge switching device comprises a field effect transistor.

10. A method of protecting over-current of a plasma display panel apparatus comprising a pair of discharge sustaining electrodes, a panel capacitor that alternately supplies a charged voltage to each of the discharge sustaining electrodes, and a plurality of switching devices that control the charged voltage to be alternately supplied from the panel capacitor to each of the discharge sustaining electrodes, the method comprising:

sensing current passing through one of the switching devices; and turning off the one switching device when the sensed current is at or above a predetermined reference value.

11. The method according to claim 10, wherein said turning off the one switching device comprises converting the sensed current into direct current voltage, and turning off the one switching device when the converted direct current voltage is at or above the predetermined reference value.

12. A sustaining electrode driving circuit for use in driving a pair of discharge sustaining electrodes in a plasma display panel, comprising:

a panel capacitor to alternately supply a charged voltage to each of the discharge sustaining electrodes;

a switching device to form a current loop with said panel capacitor through which current flows between said panel capacitor and said switching device;

a current sensing part that senses the current in the current loop; and an over-current controlling part that turns off said switching device to break off the current loop when the sensed current is at or above a predetermined reference value.

13. The sustaining electrode driving circuit according to claim 12, further comprising:

an energy collecting capacitor;

first and third switches disposed in parallel with said energy collecting capacitor, said first and third switches being connected at a second node;

a sustaining voltage source;

a second switch disposed in series with said switching device between a ground and said sustaining voltage source, said second switch and said switching device being connected at a first node;

a panel capacitor connecting switch disposed between the first node and said panel capacitor;

a coil connected between the first and second nodes;

a reset capacitor and a reset resistance connected to the first node and said second switch to reset a voltage of said panel capacitor; and a reset switch connected at a third node between said reset capacitor and said reset resistance and at a fourth node between said panel capacitor and said panel capacitor connecting switch.

14. The sustaining electrode driving circuit according to claim 12, wherein:

said switching device comprises a field effect transistor, said current sensing part is connected to a source of the field effect transistor of said switching device, and said over-current controlling part is connected to a gate of the field effect transistor of said switching device.

15. The sustaining electrode driving circuit according to claim 12, wherein:

said current sensing part comprises a current sensing resistance connected in series to said switching device, and said over-current controlling part comprises:

a comparator that compares a sensed voltage detected in the current sensing resistance due to the current in the current loop with a predetermined internal reference value and outputs a break signal, and a current break switching device that breaks the current in the current loop and turns said switching device on or off according to whether the break signal is one of a "high" signal or a "low" signal.

16. The sustaining electrode driving circuit according to claim 15, wherein said over-current controlling part further includes a direct current (DC) converting part positioned between the current sensing resistance and the comparator.

17. The sustaining electrode driving circuit according to claim 15, wherein said over-current controlling part further includes an OR gate disposed between the comparator and the current break switching device.

18. The sustaining electrode driving circuit according to claim 17, wherein the current loop is formed during a discharge of one of the sustaining electrodes.

19. The sustaining electrode driving circuit according to claim 12, wherein said over-current controlling part further comprises a microcomputer that turns off said switching device when the sensed current in the current loop is at or above the predetermined internal reference value.

20. The sustaining electrode driving circuit according to claim 12, wherein the current loop is formed during a discharge of one of the sustaining electrodes.

* * * * *